US006555787B1

(12) United States Patent
Horn et al.

(10) Patent No.: US 6,555,787 B1
(45) Date of Patent: Apr. 29, 2003

(54) THREE CONDUCTOR HEATING ELEMENT

(75) Inventors: James A. Horn, North Webster, IN (US); Stephen L. Hardin, Warsaw, IN (US); Steven M. Nimtz, Cromwell, IN (US)

(73) Assignee: Dekko Heating Technologies, Inc., North Webster, IN (US)

( * ) Notice: Subject to any disclaimer, the term of this patent is extended or adjusted under 35 U.S.C. 154(b) by 0 days.

(21) Appl. No.: 10/005,234

(22) Filed: Dec. 5, 2001

(51) Int. Cl.[7] ..... H05B 1/00

(52) U.S. Cl. ..... 219/212; 219/212; 219/528; 219/548; 219/549; 219/552; 219/553; 338/214; 338/260; 338/261; 338/262; 338/275

(58) Field of Search ..... 219/212, 528, 219/548, 549, 552, 553, 539; 338/214, 260, 261, 262, 278; 174/118

(56) References Cited

U.S. PATENT DOCUMENTS 3,249,959 A 5/1966 Theckston
3,757,086 A 9/1973 Indoe
4,392,051 A 7/1983 Goss et al.
4,503,322 A 3/1985 Kishimoto et al.
4,547,658 A * 10/1985 Crowley ..... 219/212
4,742,212 A 5/1988 Ishii et al.
5,782,301 A 7/1998 Neuroth et al.
5,861,610 A 1/1999 Weiss
6,288,372 B1 9/2001 Sandberg et al.

* cited by examiner

*Primary Examiner*—Teresa Walberg
*Assistant Examiner*—Vinod D Patel
(74) *Attorney, Agent, or Firm*—Taylor & Aust, P.C.

(57) ABSTRACT

A heating element, including a sensor conductor, two resistive conductors, with one resistive conductor arranged on one side of the sensor conductor and an other resistive conductor arranged on an other side of the sensor conductor such that the sensor conductor and the two resistive conductors are substantially parallel and plastic electrical insulation surrounding the sensor conductor and each resistive conductor.

15 Claims, 2 Drawing Sheets

THREE CONDUCTOR HEATING ELEMENT

BACKGROUND OF THE INVENTION

1. Field of the Invention.

The present invention relates to a heating system, and a method of operation thereof, which utilizes a three conductor heating element, and, more particularly, to an electric blanket which incorporates a heating element.

2. Description of the Related Art.

Blankets are woven from a variety of materials including wool, cotton, synthetics, and various animal and vegetable fibers. Blankets are used as a shawls, bed coverings and horse coverings. The blanket making of primitive people is one of the finest remaining examples of early domestic artwork. For example, the blankets of Mysore, India, are famous for their fine, soft texture. The loom of the Native American, though simple in construction, can produce blankets so closely woven as to be waterproof The Navaho, Zu ñi, Hopi, and other Southwestern Native Americans are noted for their distinctive, firmly woven blankets. The Navahos produced beautifully designed blankets characterized by geometrical designs woven with yarns colored with vegetable dyes. The ceremonial Chilcat blanket of the Tlingit of the Northwest, is generally woven with a warp of cedar bark and wool and a weft of goats' hair. Blankets, like society, have changed significantly over the years and it was in the 20th century that the electric blanket, with electric wiring between layers of fabric, gained wide popularity.

The direct conversion of electric energy into heat was first described by the English physicist James P. Joule. According to Joule's law, a conductor carrying a current generates heat at a rate proportional to the product of the resistance of the conductor and the square of the current. It is the use of this principle, of applying electrical energy to a distributed resistance incorporated in a blanket, which provides warmth to the user. Joule's law also points to a potential problem, if resistance is locally increased, in a distributed resistive element, more heat is produced in that localized area causing a local hot spot.

In spite of the advantages to the users of electric blankets, consumers have voiced concerns in several areas including EMF effects, potential for electrocution and as potential fire hazards. Manufactures of electric blankets have addressed consumer concerns with scientific studies, incorporation of safety features and marketing techniques. Regardless of the manufacturer's care in manufacturing electric blankets, localized hot spots can occur in an electric blanket as a result of either a manufacturing defect, handling damage or consumer misuse. A localized hot spot in an electric blanket may cause damage to the electric blanket, property loss and/or injury to the user.

A design utilized by some manufacturers involves helically winding conductors in the heating element; however, helical winding of conductors adds greatly to the cost of a heating element.

What is needed in the art is an electric blanket with a heating element that is economical to manufacture, is safe and provides disconnection if a localized heating problem occurs.

SUMMARY OF THE INVENTION

The present invention provides a three wire heating element, two wires electrically resistive for the production of heat and the third wire sensing the temperature thereof and a connection to one of the electrically resistive wires; an electrical insulator surrounding and separating the three wires which melts at a predetermined temperature; and a control system which is coupled to the third wire to disconnect power from the two electrically resistive wires if either comes into contact with the third wire.

The invention comprises, in one form thereof, a heating element, including a sensor conductor, two resistive conductors, with one resistive conductor arranged on one side of the sensor conductor and an other resistive conductor arranged on an other side of the sensor conductor such that the sensor conductor and the two resistive conductors are substantially parallel and plastic electrical insulation surrounding the sensor conductor and each resistive conductor.

The invention comprises, in another form thereof, a heating blanket, including a blanket, a heating element routed within the blanket, a heating element including a sensor conductor, two resistive conductors, with one resistive conductor arranged on one side of the sensor conductor and an other resistive conductor arranged on an other side of the sensor conductor such that the sensor conductor and the two resistive conductors are substantially parallel and plastic electrical insulation surrounding the sensor conductor and each resistive conductor and a control device electrically coupled with the sensor conductor and the resistive conductors.

An advantage of the present invention is that if a heating conductor overheats, electrical power thereto is removed.

Another advantage is that localized overheating of a resistive conductor is detected.

Yet another advantage is that the temperature at which a localized heating problem is detected is predetermined by the selection of the melting temperature of the electrical insulation.

A further advantage is that the heating element is easily manufactured as three parallel wires electrically separated by electrical insulation.

BRIEF DESCRIPTION OF THE DRAWINGS

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
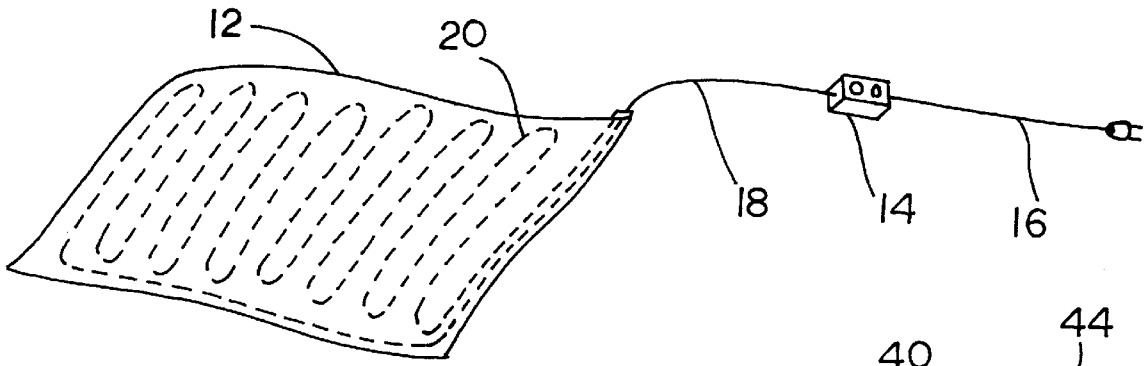
FIG. 1 is a perspective view of one embodiment of an electrical heating blanket apparatus of the present invention.

Referring now to the drawings, and more particularly to FIG. 1, there is shown an electric blanket apparatus 10 which generally includes a blanket 12, a control device 14, a power cord 16, a connecting cord 18 and a heater element 20.

Blanket 12 is a blanket which is sized for a bed and includes heater element 20 as an integral part thereof Blanket 12 may be of two layer construction with heater element 20 therebetween.

Figure 2:
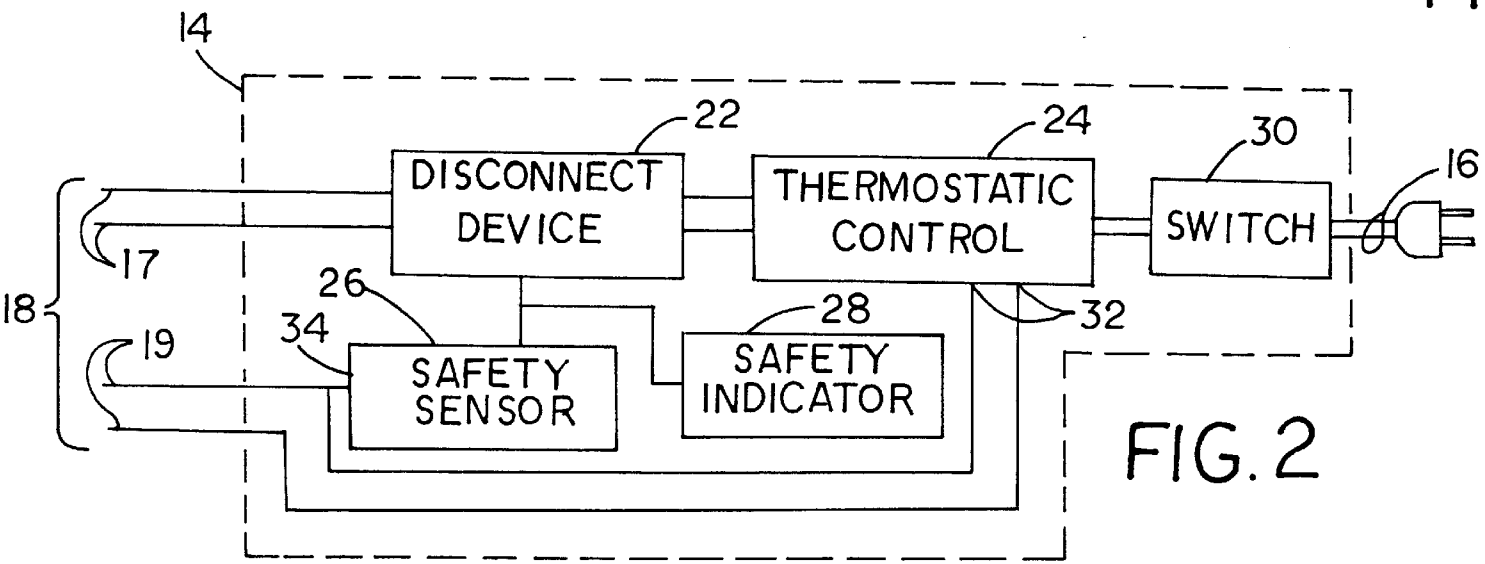
FIG. 2 is a schematic block diagram of a control device of the electrical heating blanket apparatus depicted in FIG. 1.

Now additionally referring to FIG. 2, control device 14 includes a disconnect device 22, a thermostatic control 24, a safety sensor 26, a safety indicator 28 and switch 30. Control device 14 is electrically coupled to power cord 16 and connecting cord 18.

Disconnect device 22 is electrically coupled in series with heater element 20 in order to disconnect electrical power to heater element 20 when a disconnect signal from safety sensor 26 is received. Disconnect device 22 is resetable so that control device 14 may be used with another blanket 12/heater element 20. Alternatively, disconnect device 22 may contain a sacrificial element to disconnect heater element 20 from control device 14.

Thermostatic control 24 has two sensor inputs 32 which use an electrical input to sense the temperature of blanket 12 and if the temperature is below a user selected temperature then thermostatic control 24 closes a circuit to provide an electrical connection therethrough. If the temperature of blanket 12 is equal to or above the user selected temperature, thermostatic control 24 opens a circuit, thereby disconnecting an electrical connection. If no input is coupled to sensor inputs 32 then thermostatic control 24 will not close the electrical connection.

Safety sensor 26 has a safety sensor input 34 which senses voltage and in the event a voltage is detected, above a predetermined value, safety sensor 26 outputs a disconnect signal to disconnect device 22 and safety indicator 28. Safety indicator 28 provides an indication to the user that heater element 20 has been disconnected because of a detected problem.

Switch 30 is a user operable way of turning off and on electrical blanket apparatus 10. Switch 30 is electrically coupled to power cord 16 and when switch 30 is in an on position electrical power is supplied therethrough to thermostatic control 24. Power cord 16 also provides removable connection to an electrical outlet.

Connecting cord 18 consists of four insulated conductors as shown in FIG. 2. Two of the insulated conductors 17 provide a power and a power return wire to heater element 20 from control 14. The other two insulated conductors 19 electrically couple a sensor conductor in heater element 20 to control 14.

Figure 3:
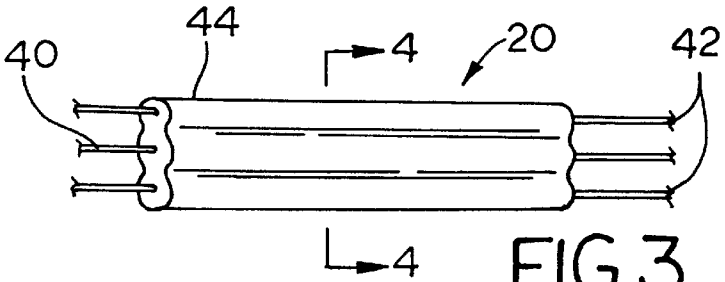
FIG. 3 is a partially sectioned view of a heating element which is disposed within the blanket of FIG. 1.
Figure 4:
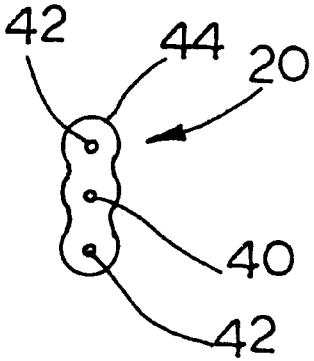
FIG. 4 is a sectional view of the heating element shown in FIG. 3, taken along line 4—4 of FIG. 3.
Figure 5:
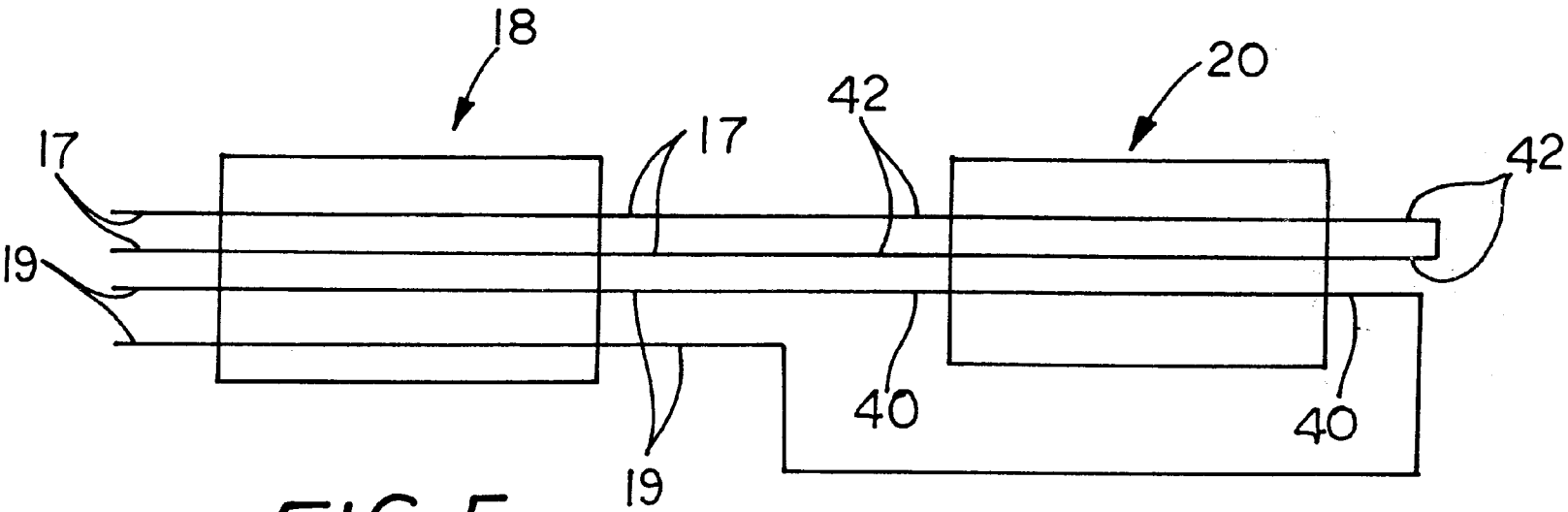
FIG. 5 is a schematic view of the electrical connections of the electrical heating blanket apparatus depicted in FIG. 1.

Now additionally referring to FIGS. 3 and 4, heating element 20 consists of one sensor conductor 40, two resistive conductors 42 and electrical insulation 44. Sensor conductor 40 is positioned between the two resistive conductors 42, such that conductor 40 and conductors 42 are arranged in a substantially equally-spaced, parallel, coplanar arrangement and are held in position by electrical insulation 44.

The two ends of sensor conductor 40 are electrically coupled respectively to the two sensor inputs 32 of thermostatic control 24 by way of conductors 19 contained in connecting cord 18. Sensor conductor 40 is at least a single strand of material which exhibits a resistive temperature coefficient that is monitored by thermostatic control 24 in order to regulate the temperature of electric blanket apparatus 10. At least one end of sensor conductor 40 is also electrically coupled to safety sensor 34 by way of the previously referred to connecting cord 18. In the event at least one of resistive conductors 42 comes into electrical contact with sensor conductor 40, safety sensor 34 detects the electrical connection and disconnect device 22 disconnects electrical power from resistive conductors 42.

Resistive conductors 42 are made of an electrically resistive material, such as a resistive metal alloy, and, in the preferred embodiment, a copper-nickel alloy, providing a distributed heating along the length of heating element 20 when electrical power is supplied thereto. Even though each resistive conductor 42 can be a single strand, in the preferred embodiment each resistive conductor 42 is multi-strand. Resistive conductors 42 are coupled to control device 14 by way of connecting cord 18.

Electrical insulation 44 is a plastic which is formulated to be thermally conductive and to melt when a portion of resistive conductors 42 overheats. The temperature at which electrical insulation 44 melts is such that an overheating of a resistive conductor 42 will not cause injury or a fire. Electrical insulation 44 is a monolithic extrusion. Alternatively, electrical insulation 44 may be constructed as multiple extrusions and/or multiple layer extrusions. A layer of plastic insulation may have a physical property of constriction when subjected to an elevated temperature. When electrical insulation 44 melts, resistive conductors 42 will not be constrained from contacting sensor conductor 40, thereby allowing electrical contact between at least one resistive sensor 42 and sensor conductor 40. An electrical contact of resistive conductor 42 to sensor conductor 40 is detected by safety sensor 26 causing disconnect device 22 to remove power from resistive conductors 42. Sensor conductor 40 is positioned between resistive conductors 42, in heating element 20, as this is the warmest place therein which will cause electrical insulation 44 to melt at that part of the structure before any other part.

Blanket 12 has a combustion temperature, which is the temperature at which blanket 12 will combust in the presence of atmospheric amounts of oxygen. Electrical insulation 44 has a melting temperature which is selected to be less than the combustion temperature of blanket 12.

During operation, electrical power is controllably supplied to heater element 20 by way of control device 14. Thermostatic control 24, of control device 14, senses the electrical resistance of sensor conductor 40, which relates to the temperature of heating element 20. The sensed temperature of heating element 20 is used to selectively supply power to heating element 20 thereby controlling the temperature of heating element 20. In the event there is a localized change in resistance of resistive conductor 42, thereby causing a localized rise in the temperature of heating element 20, also known as a localized hot spot, then electrical insulation 44, in the area of elevated temperature, melts allowing at least one resistive conductor 42 to come into electrical contact with sensor conductor 40. Electrical voltage present on a resistive conductor 42, at the point of contact with sensor conductor 40, is conducted to safety sensor 26. Voltage detected by safety sensor 26 causes safety sensor 26 to send a signal to disconnect device 22 which then disconnects electrical power from conductors 17 thereby electrically disconnecting heating element 20. The signal sent to disconnect device 22 is also sent to safety indicator 28 which provides a visual display that a fault has been detected in heating element 20 and that it has been electrically disconnected.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heating blanket, comprising:

a blanket;

a heating element routed within said blanket, said heating element comprising:

a sensor conductor;

two resistive conductors, one said resistive conductor arranged on one side of said sensor conductor and an other said resistive conductor arranged on an other side of said sensor conductor such that said sensor conductor and said two resistive conductors are substantially parallel; and plastic electrical insulation surrounding said sensor conductor and each said resistive conductor; and a control electrically coupled with said sensor conductor and said resistive conductors.

2. The heating blanket of claim 1, wherein said two resistive conductors and said sensor conductor are arranged substantially coplanar with each other, said sensor conductor being disposed between said two resistive conductors.

3. The heating blanket of claim 1, wherein said plastic electrical insulation has a melting temperature which if exceeded allows electrical contact between said sensor conductor and at least one of said two resistive conductors.

4. The heating blanket of claim 1, wherein said plastic electrical insulation is formed as one of a monolithic extrusion, multiple extrusions and multiple layer extrusions.

5. The heating blanket of claim 1, wherein said blanket has a combustion temperature and said plastic electrical insulation has a melting temperature, said melting temperature being less than said combustion temperature.

6. The heating blanket of claim 1, wherein said sensor conductor has an electrical characteristic of electrical resistance which changes in relation to a temperature of said sensor conductor.

7. The heating blanket of claim 6, wherein said control utilizes said electrical characteristic to regulate electrical power supplied to said resistive conductors and thereby control a temperature of said blanket.

8. The heating blanket of claim 1, wherein said control device comprises:

a safety sensor electrically coupled to said sensor conductor, said safety sensor outputting a disconnect signal when said sensor conductor comes into electrical contact with at least one resistive conductor;

a disconnect device electrically coupled in series with said resistive conductors, said disconnect device electrically coupled to said safety sensor and configured to disconnect electrical power to said resistive conductors when a disconnect signal is received from said safety sensor; and a thermostatic control electrically coupled to said sensor conductor, said thermostatic control detecting a temperature of said blanket and thereby regulating electrical power supplied to said resistive conductors.

9. The heating blanket of claim 1, wherein said two resistive conductors are made of a copper-nickel alloy.

10. A heating element, comprising:

a sensor conductor;

two resistive conductors, one said resistive conductor arranged on one side of said sensor conductor and an other said resistive conductor arranged on an other side of said sensor conductor such that said sensor conductor and said two resistive conductors are substantially parallel; and plastic electrical insulation surrounding said sensor conductor and each said resistive conductor.

11. The heating element of claim 10, wherein said two resistive conductors and said sensor conductor are arranged substantially coplanar with each other, said sensor conductor being disposed between said two resistive conductors.

12. The heating element of claim 10, wherein said plastic electrical insulation has a melting temperature which if exceeded allows electrical contact between said sensor conductor and at least one of said two resistive conductors.

13. The heating element of claim 10, wherein said plastic electrical insulation is formed as one of a monolithic extrusion, multiple extrusions and multiple layer extrusions.

14. The heating element of claim 10, wherein said sensor conductor has an electrical characteristic of electrical resistance which changes in relation to a temperature of said sensor conductor.

15. The heating element of claim 10, wherein said two resistive conductors are made of an electrically resistive alloy.

* * * * *